United States Patent [19]

Baillievier

[11] 4,408,444

[45] Oct. 11, 1983

[54] STEEL CORD FOR REINFORCEMENT OF ELASTOMER MATERIAL

[75] Inventor: Freddy Baillievier, Zwevegem, Belgium

[73] Assignee: N.V. Bekaert S.A., Zwevegem, Belgium

[21] Appl. No.: 371,722

[22] Filed: Apr. 26, 1982

[30] Foreign Application Priority Data

May 8, 1981 [NL] Netherlands ..... 8102273

[51] Int. Cl.[3] ..... D07B 1/00; D02G 3/48

[52] U.S. Cl. ..... 57/237; 57/211; 57/902

[58] Field of Search ..... 57/200, 206, 207, 210, 57/211, 212, 215, 218, 231, 236, 237, 902

[56] References Cited

U.S. PATENT DOCUMENTS

| | | | |
|---|---|---|---|
| 2,113,710 | 4/1938 | Riddle | 57/215 X |
| 2,491,293 | 12/1949 | Zerr | 57/215 X |
| 3,659,038 | 4/1972 | Shealy | 57/215 X |
| 4,176,513 | 12/1979 | Young et al. | 57/237 |

*Primary Examiner*—Donald Watkins

*Attorney, Agent, or Firm*—E. J. Brenner

[57] ABSTRACT

A steel cord for the reinforcement of elastomer material. comprising two equivalent wire groups of at least two wires each, the wire groups being twisted around each other, in which the wires of the first group are parallel or nearly parallel, and the wires of the second group are twisted around each other with a twist pitch of the same sense and the same value as the twist pitch with which the two groups are twisted together.

4 Claims, 3 Drawing Figures

STEEL CORD FOR REINFORCEMENT OF ELASTOMER MATERIAL

The invention relates to a steel cord for the reinforcement of elastomer material, such as rubber, comprising two equivalent wire groups of at least two steel wires each. The wire groups being twisted around each other and forming helicoids of a same pitch and substantially same form. Wires are considered here to form a "group", when they form a wire bundle, in which the wires have a certain twist pitch around each other. If the twist pitch has an infinite value, the wire group then consists of parallel wires which are not twisted around each other.

The notion of a structure of two "equivalent" wire groups stands in contrast to a structure consisting of a core wire group and a wrapping wire group of substantially less wires than in the core group. In the latter case, when both groups are simply twisted together without predeformation of the core wire group before twisting, the core has a much more straight form than the wrapping wires, which are wound around the core, instead of both groups to be twisted around each other to a substantially same helicoidal form. The wrapping wire group does not contribute to the tensile strength, and special deformation measures of the core wire group must be taken when it is desired to change this. This is not the case and puts no problem in cords composed of two wire groups having a sufficiently similar number of wires or steel cross section in each group. Such groups are, by the simple fact of twisting them around each other, deformed into helicoids of a same pitch and substantially same form, and each group contributes to the tensile strength in a substantially same way. Cords consisting of two or more such equivalent wire groups are sufficiently known in the art and the cord with relation to the invention consists of two such groups.

For being adapted for use as a reinforcement of elastomer material, the wire diameters range between 0,10 mm and 0,40 mm and the pitch of the wire groups around each other ranges between 3 mm and 25 mm. These wires are then preferably covered with a layer for adhesion to rubber, e.g. a brass layer.

It is known for a core group of parallel wires that it allows a better penetration of the rubber in which it is embedded, e.g. from Belgian Pat. No. 655.590. And for steel cord consisting of two or more equivalent wire groups, it has also been proposed to use groups of parallel wires, because, amongst other reasons, the twisting equipment for the wires into a group can be avoided, e.g. in Luxemburg Pat. No. 65.321 and French Pat. No. 2.453.933. In the cord to which the invention relates, one group of wires has a large twist pitch, e.g. at least 300 mm, so as to form a bundle of parallel wires or nearly parallel wires to take advantage of these known facts. The twist pitch of the wires in this group consequently differs from the pitch of the helicoids to which the groups themselves have been twisted together.

The cord according to the invention is however characterized by the fact that the twist pitch of the second group is in the same sense and of the same value as the pitch of said helicoids.

Such cord can be mae, also without the need of special twisting equipment for providing the second wire group with its twist pitch, and the cord reconciles in a better way than heretofore the requirements of compactness and good rubber penetration. It forms an alternative for existing cord structures, for use in vehicle tires, high pressure hoses, conveyor belts and transmission belts. Preferred structures are two groups of an equal number of wires: 2+2, 3+3, 4+4, preferably of the same diameter. In this 2+2-version they are especially usable for the reinforcing belt of vehicle tires.

Preferably, the twist pitch of the first group has an infinite value so as to form a bundle of parallel wires.

A cord according to the invention, and one way how to make the same, will be explained hereunder by way of example and with reference to the drawings in which FIG. 1 is a schematic view of an apparatus for making the cord according to the invention.

Figure 1:
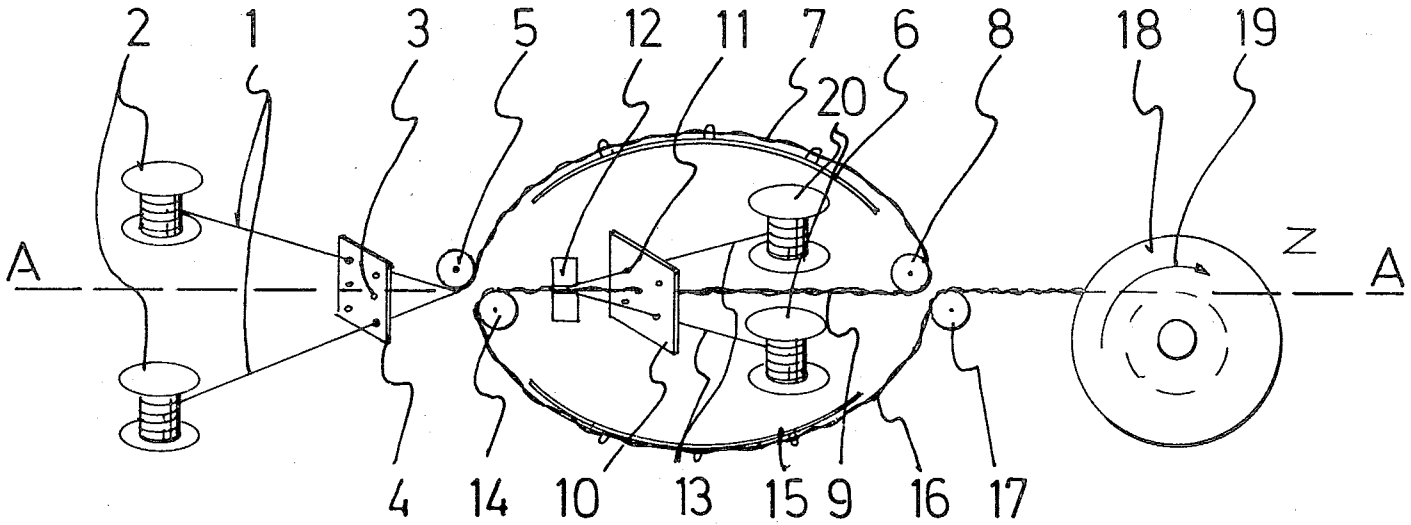

The twisting apparatus schematically shown in FIG. 1 shows, as rotating parts in the same sense and at the same angular speed around the axis AA: the guiding wheels 5 and 14 at the entrance side of the machine and guiding wheels 8 and 17 at the exit side, and also the rotating strand guides 6 and 15 between entrance and exit side. Inside the machine are located in a cradle, as well known in the art of making steel cord, so as not to rotate and to keep the same position with respect to the fixed parts of the machine: a number, in this case two, of bobbin holders (not shown) with their respective bobbins 20, a guiding plate 10 with openings 11, and a bundling-die 12. Outside the rotating parts, the apparatus further comprises: at the entrance side, a number, in this case two, of bobbin holders (not shown) with their respective bobbins 2 rotatable around their own axis, a guiding plate 4 with openings 3, and at the exit side, the winding-up reel 18, rotating in the sense of arrow 19.

In operation, the sense of rotation of the rotating parts is counterclockwise, when looking in the sense from entrance to exit side. Two wires 1, intended for forming the first wire group in the finally produced cord are reeled off from bobbins 2, pass through guiding plate 4, and are further guided over guiding wheel 5 and rotating strand guide 6 towards guiding wheel 8. In the section between guiding plate 4 and guiding wheel 8, these wires are twisted together in the S-sense to a strand 7 having twice the pitch with which the groups will be twisted together in the finally produced cord. Over guiding wheel 8, the travelling sense of this strand is reversed, and it travels now, in coincidence with the axis of rotation AA, but in the sense from exit to entrance, through an opening in guiding plate 10, and further through the bundling-die 12, towards guiding-wheel 14. In the bundling-die, this strand 9 receives two other wires 13, intended for forming the second group in the finally produced cord. These cords are reeled off from the bobbins 10, which are guided through a respective opening in the guiding plate 10, towards the bundling-die, and which further travel with strand 9 towards the guiding wheel 14, where the sense of travelling is again reversed.

In the section between guding wheels 8 and 14, the strand 9 may undergo a further twist to maximum the same twist as given in the first section, between guding-wheel 8 and bundling-die 12, but this is immediately neutralized by a same twist in the reverse sense between bundling-die 12 and guiding-wheel 14. Such maximum twist is given indeed when the bundling-die 12 does not allow axial rotation of the bundle around its own axis. This strand in the cord leaving the guiding wheel 14 consequently has still a twist in the S-sense with a same double pitch as strand 7. The wires 13 however that have joined this strand in the bundling-die 12, have undergone a twist around each other, with the same double pitch, but in the reverse senses, or Z-sense. The separate wires also undergo a torsion.

This cord, leaving the guiding wheel 14 as a cord of two wires in the S-sense and two wires in the Z-sense, are further guided over rotating strand guide 15, and guiding-wheel 17 towards the winding-up reel 18. In this section, the S-strand consisting of the wires coming from bobbins 2 is untwisted to a bundle of two parallel wires, and the Z-strand consisting of the wires coming from bobbins 20 is further twisted to the same twist-pitch as th e twist-pitch with which the bundle of parallel wires and the Z-strand are bundled together. The separate wires of this Z-strand also undergo a further torsion, and so receive a permanent torsional deformation. The instruments for straightening and closing the final cord, which are conventionally used before the winding-up reel, are not shown in this drawing, but well known to those skilled in the art.

If desirable, the guiding plates 4 and 10 can be made and located with respect to guiding wheel 5 or bundling-die 11 respectively, so as to give a deformation before bundling.

Figure 2:
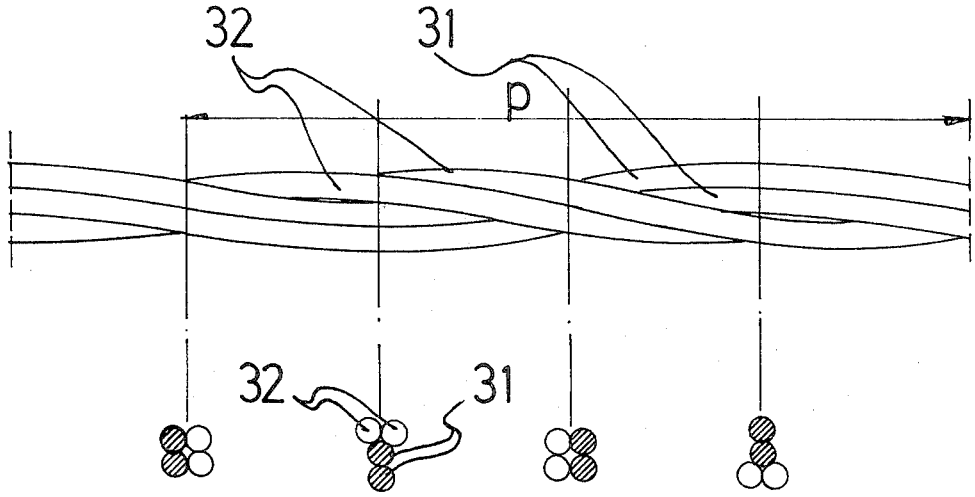
FIG. 2 is a cord as obtained by using the apparatus.

The cable obtained with this apparatus is shown in FIG. 2. It comprises a first group of two wires 31 and a second group of two wires 32. Both groups are twisted together around each other into helicoids with a pitch p. FIG. 2 shows a side view and four cross-sections, at a quarter of a pitch distance from each other. The wires 31 in the first group have no twist around each other, because in the process explained above the initially given twist is eliminated by a final twist in the reverse sense. The wires 32 however of the second group show a twist around each other in the same sense and with a same twist pitch p.

The wires of the first group need not necessarily be parallel to each other and have an infinite pitch. The rubber penetration is still good for large pitch values and the cord can be made in a simple way with the same equipment as in FIG. 1, but the machine is fed at the entrance side, not by two parallel untwisted wires 1, but by a strand of wires, e.g. two wires, having a very large pitch P.

Figure 3:
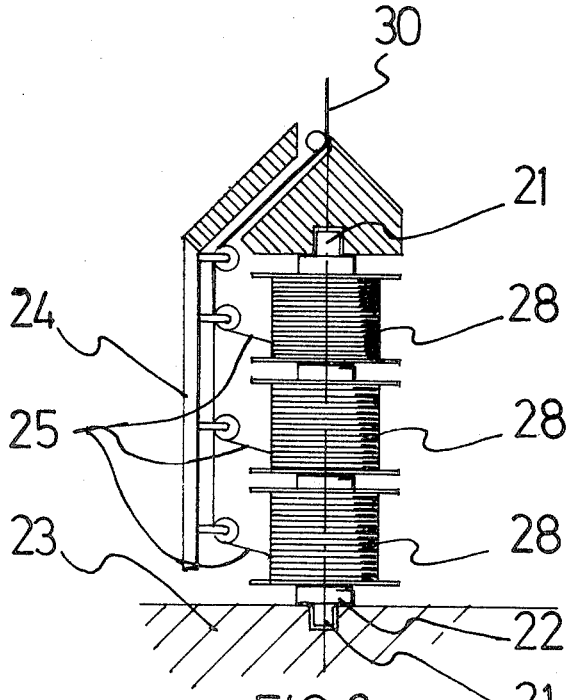
FIG. 3 is a side view of an apparatus for providing, in a simple way, the first wire group with a large pitch.

Forming such strand is possible with an apparatus according to FIG. 3, which shows a side view of an apparatus for drawing three wires 25, each from a respective spool 28, which spools are coaxially mounted on a same vertical axis 21, which is mounted in an reposes on bearing 22 which is fixed in the ground 23.

An arm 24, rotatable around axis 21, when rotating around said axis, draws off the wire from the fixed spools 28, and brings them into a bundle 30, coaxial with said axis 21. At each revolution of arm 24, the bundle 30 undergoes one torsion. In practice, this means a very large pitch P for this bundle 30 or wire group, e.g. between 300 and 1000 mm. This pitch can be varied by making the spools 28 to rotate around axis 21. The rotation of arm 24 can be in one sense, or in the opposite sense. In such a way the pitch of this first wire group is relatively large, and goes in the same, or in the opposite sense as the pitch of the second wire group.

The invention is not limited to the example given hereabove, but other structures of more than two wires per group are possible and other similar structures which do not depart from the scope of this invention.

I claim:

1. A steel cord adapted for the reinforcement of elastomer material, comprising two equivalent wire groups of at least two wires each, the wire groups being twisted around each other and forming helicoids of a same pitch and substantially same form, the wires of the first group having a twist pitch that differs from the pitch of said helicoids, and has a value of more than 300 mm, characterized by the fact that the twist pitch of the second group is in the same sense and has the same value as the pitch of said helicoids.

2. A steel cord according to claim 1, in which the number of wires in the second group is equal to the number in the first group and ranges from two to four.

3. A steel cord according to any one of claims 1 or 2, in which the twist pitch of the first group has an infinite value so as to form a bundle of parallel wires.

4. A steel cord according to claim 3 in which each group comprises two wires.

* * * * *